US006888438B2

(12) United States Patent
Hui et al.

(10) Patent No.: US 6,888,438 B2
(45) Date of Patent: May 3, 2005

(54) PLANAR PRINTED CIRCUIT-BOARD TRANSFORMERS WITH EFFECTIVE ELECTROMAGNETIC INTERFERENCE (EMI) SHIELDING

(75) Inventors: Ron Shu Yuen Hui, Shatin (HK); Sai Chun Tang, Yuen Long (HK)

(73) Assignee: City University of Hong Kong, Kowloon (HK)

( * ) Notice: Subject to any disclaimer, the term of this patent is extended or adjusted under 35 U.S.C. 154(b) by 190 days.

(21) Appl. No.: 10/282,335

(22) Filed: Oct. 28, 2002

(65) Prior Publication Data

US 2003/0095027 A1 May 22, 2003

Related U.S. Application Data

(63) Continuation-in-part of application No. 09/883,145, filed on Jun. 15, 2001, now Pat. No. 6,501,364.

(51) Int. Cl.[7] ..... H01F 5/00
(52) U.S. Cl. ..... 336/200; 336/232; 336/223
(58) Field of Search ..... 336/200, 223, 336/232; 29/602.1

(56) References Cited

U.S. PATENT DOCUMENTS 3,866,086 A * 2/1975 Miyoshi et al.
4,494,100 A * 1/1985 Stengel et al.
4,510,915 A * 4/1985 Ishikawa et al.
4,613,843 A * 9/1986 Esper et al.
4,748,532 A * 5/1988 Commander et al.
4,890,083 A * 12/1989 Trenkler et al.
5,039,964 A * 8/1991 Ikeda
5,431,987 A * 7/1995 Ikeda
5,487,214 A * 1/1996 Walters ..... 29/602.1
5,502,430 A * 3/1996 Takahashi et al.
5,579,202 A * 11/1996 Tolfsen et al.
5,592,089 A * 1/1997 Danby et al.
5,844,451 A * 12/1998 Murphy
6,023,161 A * 2/2000 Dantsker et al.
6,420,953 B1 * 7/2002 Dadafshar ..... 336/200

FOREIGN PATENT DOCUMENTS

EP 0 147 499 * 7/1985
JP 54-110424 * 8/1979
JP 4-10680 * 1/1992
JP 6013247a * 1/1994
JP 20011110651 A * 4/2001

OTHER PUBLICATIONS

Tang et al., "Coreless planar printed–circuit–board (PCB) transformers—A fundamental concept for signal and energy transfer," *IEEE Transactions on Power Electronics*, vol. 15, No. 5, pp. 931941 (Sep. 2000).*

Hui et al., "Coreless printed–circuit board transformers for signal and energy transfer," *Electronics Letters*, vol. 34, No. 11, pp. 1052–1054 (May 1998).*

(Continued)

*Primary Examiner*—Elvin Enad
*Assistant Examiner*—Jennifer A. Poker
(74) *Attorney, Agent, or Firm*—Merchant & Gould P.C.

(57) ABSTRACT

Novel designs for printed circuit board transformers, and in particular for coreless printed circuit board transformers designed for operation in power transfer applications, in which shielding is provided by a combination of ferrite plates and thin conductive sheets.

7 Claims, 8 Drawing Sheets

OTHER PUBLICATIONS

Hui et al., "Some electromagnetic aspects of coreless PCB transformers," *IEEE Transactions on Power Electronics*, vol. 15, No. 4, pp. 805–810 (Jul. 2000).*

Onda et al., "Thin type DC/DC converter using a coreless wire transformer," *IEEE Power Electronics Specialists Conference*, pp. 1330–1334 (Jun. 1994).

Coombs, C.F., "Printed Circuits Handbook," 3rd Ed. McGraw–Hill, p. 6.32 (1998).

Tang et al., "Characterization of coreless printed circuit board (PCB) transformers," *IEEE Transactions on Power Electronics*, vol. 15, No. 6, pp. 1275–1282 (Nov. 2000).

Paul, C.R., *Introduction to Electromagnetic Compatibility*, Chapter 11—Shielding, pp. 632–637 (1992).

Tang et al., "A low–profile power converter using printed–circuit board (PCB) power transformer with ferrite polymer composite," *IEEE Transactions on Power Electronics*, vol. 16, No. 4, pp. 493–498 (Jul. 2001).

Hui et al., "Coreless PCB based transformers for power MOSFET/IGBT gate drive circuits," *IEEE Power Electronics Specialists Conference*, vol. 2, 1171–1176 (1997).

Bourgeois, J.M., "PCB Based Transformer for Power MOSFET Drive," *IEEE*, pp. 238–244 (1994).

Goyal, R., "High–Frequency Alalog Integral Circuit Design," pp. 107–126 (1995).

* cited by examiner

PLANAR PRINTED CIRCUIT-BOARD TRANSFORMERS WITH EFFECTIVE ELECTROMAGNETIC INTERFERENCE (EMI) SHIELDING

This application is a continuation in part of U.S. Utility application Ser. No. 09/883,145, filed Jun. 15, 2001, subsequently issued as U.S. Pat. No. 6,501,364 on Dec. 21, 2002, entitled PLANAR PRINTED-CIRCUIT BOARD TRANSFORMERS WITH EFFECTIVE ELECTROMAGNETIC INTERFERENCE (EMI) SHIELDING, which is in its entirety incorporated herewith by reference, and of which the present application is a continuation-in-part.

FIELD OF THE INVENTION

This invention relates to a novel planar printed-circuit-board (PCB) transformer structure with effective (EMI) shielding effects.

BACKGROUND OF THE INVENTION

Planar magnetic components are attractive in portable electronic equipment applications such as the power supplies and distributed power modules for notebook and handheld computers. As the switching frequency of power converter increases, the size of magnetic core can be reduced. When the switching frequency is high enough (e.g. a few Megahertz), the magnetic core can be eliminated. Low-cost coreless PCB transformers for signal and low-power (a few Watts) applications have been proposed by the present inventors in U.S. patent applications Ser. No. 08/018,871 and U.S. Ser. No. 09/316,735 the contents of which are incorporated herein by reference.

It has been shown that the use of coreless PCB transformer in signal and low-power applications does not cause a serious EMC problem. In power transfer applications however, the PCB transformers have to be shielded to comply with EMC regulations. Investigations of planar transformer shielded with ferrite sheets have been reported and the energy efficiency of a PCB transformer shielded with ferrite sheets can be higher than 90% in Megahertz operating frequency range. However, as will be discussed below, the present inventors have found that using only thin ferrite materials for EMI shielding is not effective and the EM fields can penetrate the thin ferrite sheets easily.

PRIOR ART

FIGS. 1 and 2 show respectively an exploded perspective and cross-sectional view of a PCB transformer shielded with ferrite plates in accordance with the prior art. The dimensions of the PCB transformer under test are detailed in Table I. The primary and secondary windings are printed on the opposite sides of a PCB. The PCB laminate is made of FR4 material. The dielectric breakdown voltage of typical FR4 laminates range from 15 kV to 40 kV. Insulating layers between the copper windings and the ferrite plates should have high thermal conductivity in order to facilitate heat transfer from the transformer windings to the ferrite plates and the ambient. The insulating layer should also be a good electrical insulator to isolate the ferrite plates from the printed transformer windings. A thermally conductive silicone rubber compound coated onto a layer of woven glass fibre, which has breakdown voltage of 4.5 kV and thermal conductivity of 0.79 $Wm^{-1}K^{-1}$, is used to provide high dielectric strength and facilitate heat transfer. The ferrite plates placed on the insulating layers are made of 4F1 material from Philips. The relative permeability, $\mu_r$, and resistivity, $\rho_1$, of the 4F1 ferrite material are about 80 and $10^5$ Ωm, respectively.

SUMMARY OF THE INVENTION

According to the present invention there is provided a planar printed circuit board transformer comprising at least one copper sheet for electromagnetic shielding.

Viewed from another aspect the invention provides a planar printed circuit board transformer comprising, (a) a printed circuit board, (b) primary and secondary windings formed by coils deposited on opposed sides of said printed circuit board, (c) first and second ferrite plates located over said primary and secondary windings respectively, and (d) first and second conductive sheets located over said first and second ferrite plates respectively.

BRIEF DESCRIPTION OF THE DRAWINGS

An embodiment of the invention will now be described by way of example and with reference to the accompanying drawings, in which:-

DETAILED DESCRIPTION OF PREFERRED EMBODIMENTS

Figure 1:
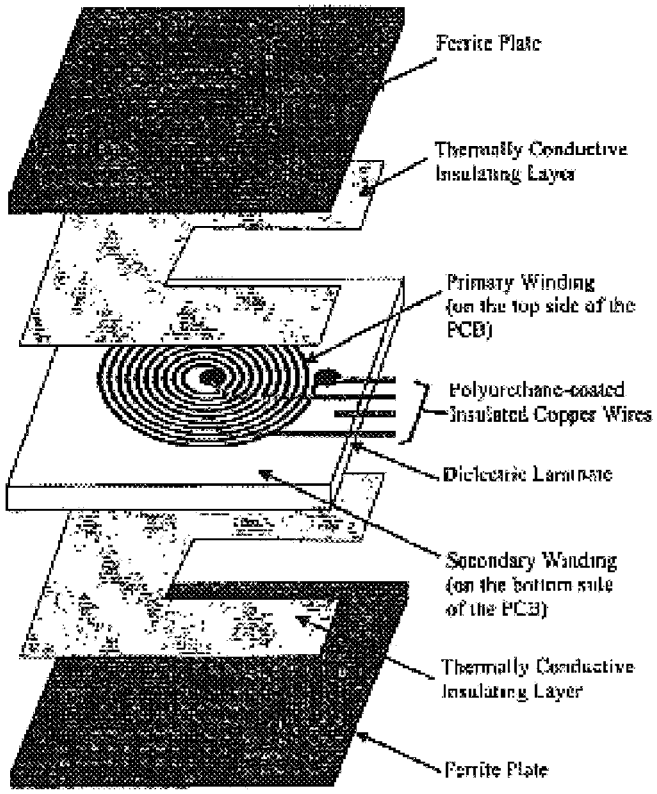
FIG. 1 is an exploded perspective view of a PCB transformer in accordance with the prior art.
Figure 2:
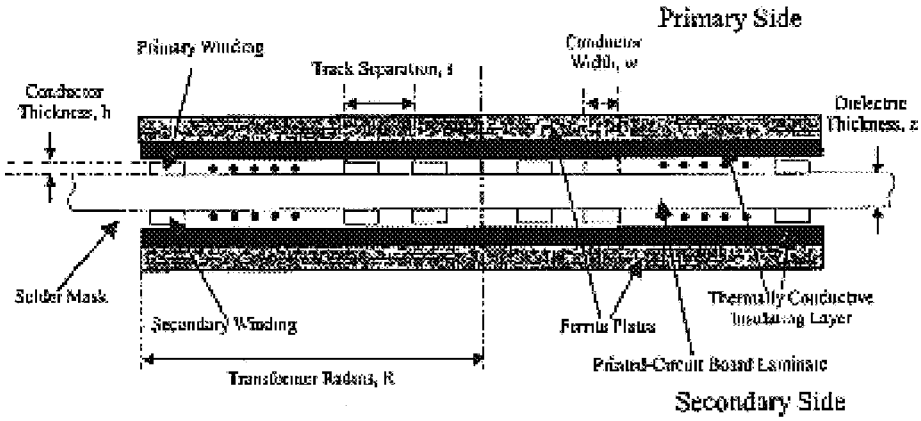
FIG. 2 is a cross-sectional view of the prior art transformer of FIG. 1, FIGS. 3(*a*) and (*b*) are exploded perspective and cross-sectional views respectively of a PCB transformer in accordance with an embodiment of the present invention.
Figure 3A:
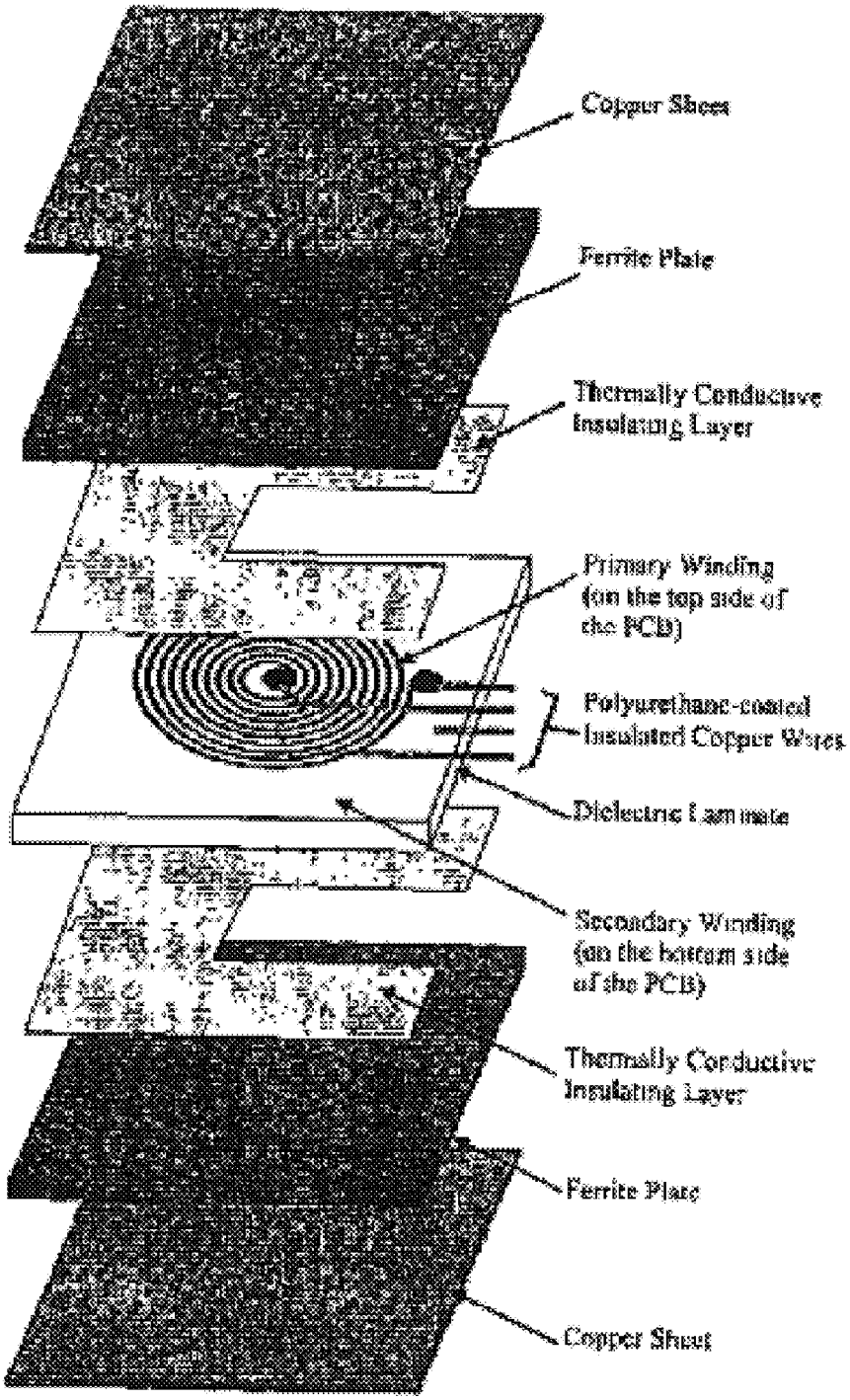
Figure 3B:
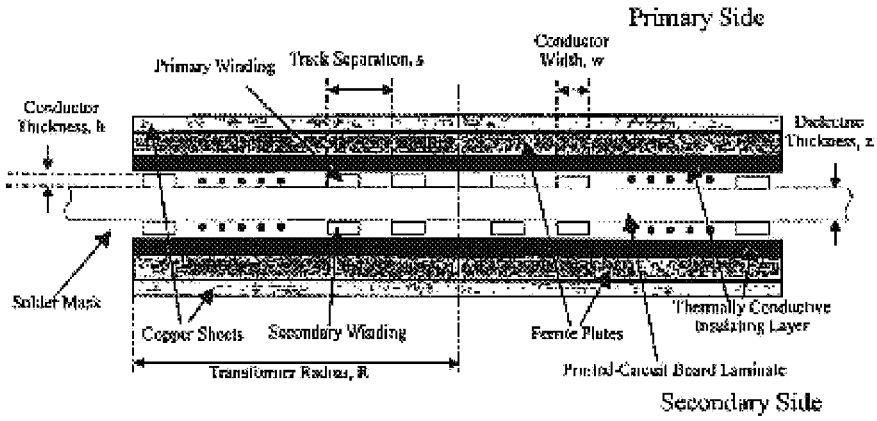

In accordance with the present invention, the ferrite shielded transformer of the prior art shown in FIGS. 1 and 2 can be modified to improve the magnetic field shielding effectiveness by providing a conductive sheet (for example of copper or aluminum) on the surface of each ferrite plate as shown in FIGS. 3(*a*) and (*b*). As an example, the modified transformer and the ferrite-shielded transformer are of the same dimensions as shown in Table I. The area and thickness of the conductive sheets in the example arc 25 mm×25 mm and 70 $\mu$m, respectively.

Figure 4:
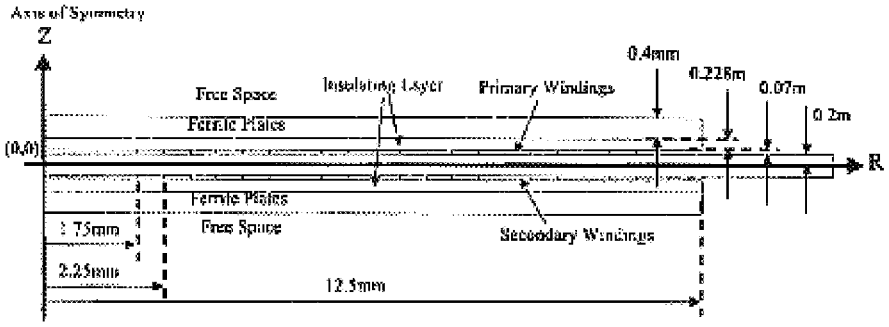
FIG. 4 shows the R-Z plane of a prior art PCB transformer.

The magnetic field intensity generated from the shielded PCB transformers is simulated with a 2D field simulator using a finite-element-method (FEM). A cylindrical coordinates system is chosen in the magnetic field simulation. The drawing model, in R-Z plane, of the PCB transformer shown in FIG. 4 is applied in the field simulator. The z-axis is the axis of symmetry, which passes through the center of the transformer windings. In the 2D simulation, the spiral circular conductive tracks are approximated as concentric circular track connected in series. The ferrite plates and the insulating layers adopted in the simulation model are in a circular shape, instead of in a square shape in the transformer prototype. The ferrite plates and the insulating layers may be made of any conventional materials.

A. Transformer Shielded with Ferrite Plates

The use of the ferrite plates helps to confine the magnetic field generated from the transformer windings. The high relative permeability, $\mu_r$, of the ferrite material guides the magnetic field along and inside the ferrite plates. In the transformer prototype, 4F1 ferrite material is used though any other conventional ferrite material cold also be used. The relative permeability of the 4F1 material is about 80.

Based on the integral form of the Maxwell equation, $$\oint_C \vec{\beta} \cdot d\vec{s} = 0 \tag{1}$$

the normal component of the magnetic flux density is continuous across the boundary between the ferrite plate and free space. Thus, at the boundary, $$B_{1n}=B_{2n} \tag{2}$$

where $B_{1n}$ and $B_{2n}$ are the normal component (in z-direction) of the magnetic flux density in the ferrite plate and free space, respectively.

From (2), $$\mu_r\mu_0 H_{1n}=\mu_0 H_{2n}$$

$$\Rightarrow$$

$$H_{2n}=\mu_r H_{1n} \tag{3}$$

Figure 5:
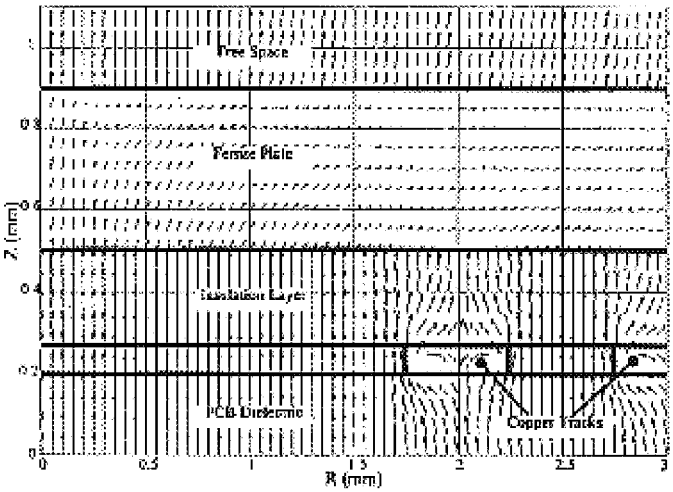
FIG. 5 is a plot of the field intensity vector of a conventional PCB transformer, FIG. 6 plots the tangential and normal components of magnetic field intensity near the boundary between the ferrite plate and free space in a PCB transformer of the prior art.

From (3), at the boundary between the ferrite plate and free space, the normal component of the magnetic field intensity in free space can be much higher than that in the ferrite plate when the relative permeability of the ferrite material is very high. Therefore, when the normal component of the H-field inside the ferrite plate is not sufficiently suppressed (e.g. when the ferrite plate is not thick enough), the H-field emitted from the surface of the ferrite plates can be enormous. FIG. 5 shows the magnetic field intensity vector plot of the transformer shielded with ferrite plates. The primary is excited with a 3A 3 MHz current source and the secondary is left open. The size of the arrows indicates the magnitude of the magnetic field intensity in dB A/m. FIG. 5 shows that the normal component of the H-field inside the ferrite plate is not suppressed adequately and so the H-field emitted from the ferrite plate to the free space is very high.

Figure 6:
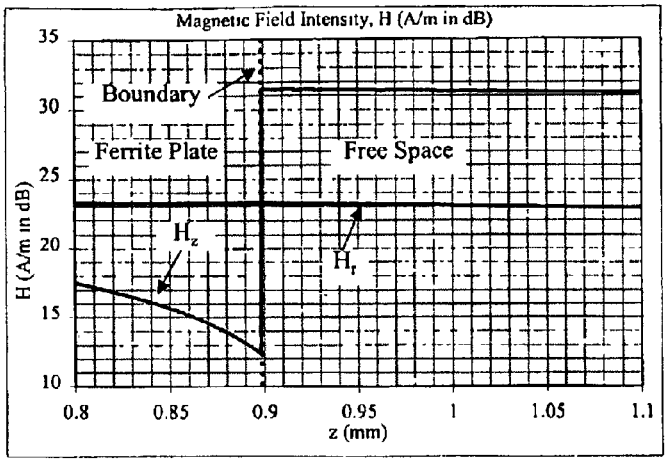

The tangential ($H_r$) and normal ($H_z$) components of magnetic field intensity near the boundary between the ferrite plate and free space, at R=1 mm, are plotted in FIG. 6. The tangential H-field ($H_r$) is about 23.2 dB and is continuous at the boundary. The normal component of the H-field ($H_z$) in the free space is about 31.5 dB and that inside the ferrite plate is about 12.5 dB at the boundary. The normal component of the H-field is, therefore, about 8% of the resultant H-field inside the ferrite plate at the boundary. Thus, the ferrite plate alone cannot completely guide the H-field in the tangential direction. As described in (3), the normal component of the H-field in the free space is 80 times larger than that in the ferrite plate at the boundary. From the simulated results in FIG. 6, the normal component of the magnetic field intensity in the free space is about 19 dB, i.e. 79.4 times, higher than that inside the ferrite plate. Thus, both simulated results and theory described in (3) show that the using ferrite plates only is not an effective way to shield the magnetic field generated from the planar transformer.

TABLE I

Geometric Parameters of the PCB Transformer

| Geometric Parameter | Dimension |
|---|---|
| Copper Track Width | 0.25 mm |
| Copper Track Separation | 1 mm |
| Copper Track Thickness | 70 $\mu$m (2 Oz/ft$^2$) |
| Number of Primary Turns | 10 |
| Number of Secondary Turns | 10 |
| Dimensions of Ferrite Plates | 25 mm × 25 mm × 0.4 mm |
| PCB Laminate Thickness | 0.4 mm |
| Insulating Layer Thickness | 0.228 mm |
| Transformer Radius | 23.5 mm |

B. Transformer Shielded with Ferrite Plates and Copper Sheets

A PCB transformer using ferrite plates coated with conductive sheets formed of copper as a shielding (FIGS. 3(*a*) and (*b*)) has been fabricated. The size of the copper sheets is the same as that of the ferrite plate but its thickness is merely 70 $\mu$m. Thin copper sheets are required to minimize the eddy current flowing in the z-direction, which may diminish the tangential component of the H-field.

Based on the integral form of the Maxwell equation, $$\oint_C \vec{H} \cdot d\vec{l} = \vec{J} + \oint_C \frac{\partial \vec{D}}{\partial t} d\vec{s} \tag{4}$$

and assuming that the displacement current is zero and the current on the ferrite-copper boundary is very small and negligible, the tangential component of the magnetic field intensity is continuous across the boundary between the ferrite plate and free space. Thus, at the boundary, $$H_{1t}=H_{2t} \tag{5}$$

where $H_{1t}$ and $H_{2t}$ are the tangential component (in r-direction) of the magnetic field intensity in the ferrite plate and copper, respectively. Because the tangential H-field on the surfaces of the copper sheet and the ferrite plates are the same at the boundary, thin copper sheets have to be adopted to minimize eddy current loss.

Consider the differential form of the Maxwell equation at the ferrite-copper boundary, $$\nabla \times \overset{\rho}{E} = -\frac{\partial \overset{\rho}{B}}{\partial t} \tag{6}$$

the magnetic field intensity can be expressed as $$\Rightarrow \overset{\rho}{H} = -\frac{1}{j\,\omega\mu\sigma}\nabla \times \overset{\rho}{J} \tag{7}$$

where ω, $\mu$ and σ are the angular frequency, permeability and conductivity of the medium, respectively. Because copper is a good conductor ($\sigma=5.80\times10^7$ S/m) and the operating frequency of the PCB transformer is very high (a few megahertz), from (7), the magnetic field intensity, H, inside the copper sheet is extremely small. Accordingly, the normal component of the H-field inside the copper sheet is also small. Furthermore, from (3), at the ferrite-copper boundary, the normal component of the H-field inside the ferrite plate is 80 times less than that inside the copper sheet. As a result, the normal component of the H-field inside the ferrite plate can be suppressed drastically.

Figure 7:
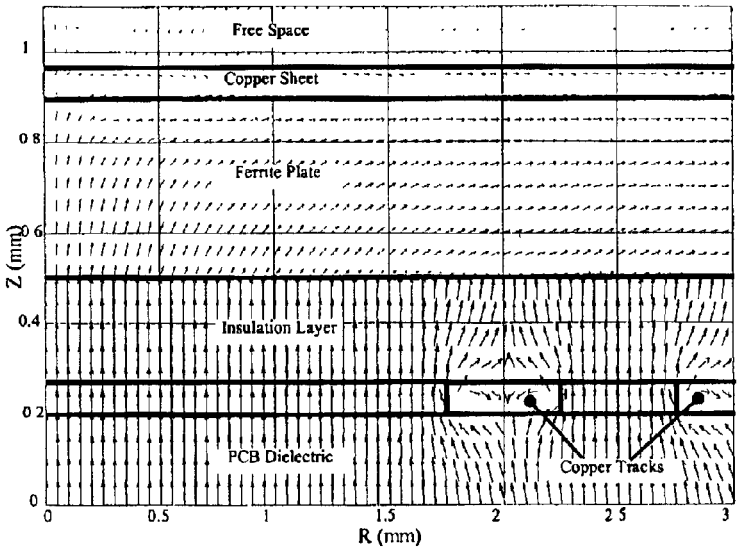
FIG. 7 is a plot of the field intensity vector of a PCB transformer according to the embodiment of FIGS. 3(*a*) and (*b*), FIG. 8 plots the tangential and normal components of magnetic field intensity near the copper sheet in a PCB transformer according to the embodiment of FIGS. 3(*a*) and (*b*)
Figure 8:
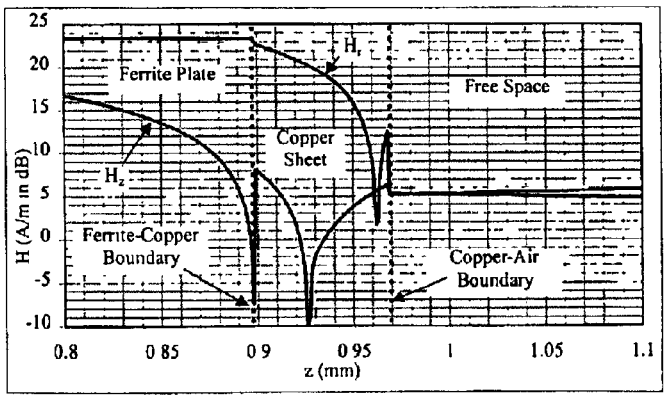

By using finite element methods, the magnetic field intensity vector plot of the PCB transformer shielded with ferrite plates and conductive sheets has been simulated and is shown in FIG. 7. The tangential ($H_r$) and normal ($H_z$) components of magnetic field intensity near the conductive sheet, at R=1 mm, are plotted in FIG. 8. From FIG. 8, the tangential H-field ($H_r$) is about 23 dB and approximately continuous at the boundary. The normal component of the H-field ($H_z$) in conductive sheet is suppressed to about 8 dB and that inside the ferrite plate is about −7.5 dB at the boundary. Therefore, the normal component of the H-field is, merely about 0.09% of the resultant H-field inside the ferrite plate at the boundary. Accordingly, at the ferrite-conductive sheet boundary, the H-field is nearly tangential and confined inside in the ferrite plate. Besides, the normal component of the H-field emitted into the conductive sheet and the free space can be neglected in practical terms. Since the normal component of the H-field emitted into the conductive sheet is very small, the eddy current loss due to the H-field is also very small. This phenomenon is verified by the energy efficiency measurements of the ferrite-shielded PCB transformers with and without conductive sheets described below. As a result, the use of ferrite plates covered with conductive sheets is an effective way to shield the magnetic field generated from the transformer windings without diminishing the transformer energy efficiency.

The shielding effectiveness (SE) of barrier for magnetic field is defined as [10]

$$SE = 20\log_{10}\left|\frac{\overset{\rho}{H}_t}{\overset{\rho}{H}_i}\right| \tag{8}$$

or $$SE = 2\times10\log_{10}\left|\frac{\overset{\rho}{H}_t}{\overset{\rho}{H}_i}\right| = 2\times\left(\left|\overset{\rho}{H}_t(\ln d\beta)\right| - \left|\overset{\rho}{H}_i(\ln d\beta)\right|\right)$$

where $\check{H}_i$ is the incident magnetic field intensity and $\check{H}_t$ is the magnetic field intensity transmits through the barrier. Alternatively, the incident field ban be replaced with the magnetic field when the barrier is removed.

Magnetic field intensity generated from the PCB transformers with and without shielding has been simulated with FEM 2D simulator and measured with a precision EMC scanner. In the field simulation, the primary side of the transformer is excited with a 3 MHz 3A current source. However, the output of the magnetic field transducer in the EMC scanner will be clipped when the amplitude of the high-frequency field intensity is too large. Thus, the 3 MHz 3A current source is approximated as a small signal (0.1A) 3 MHz source superimposed into a 3A DC source because the field transducer cannot sense DC source. In the measurement setup, a magnetic field transducer for detecting vertical magnetic field is located at 5 mm below the PCB transformer.

A. PCB Transformer Without Shielding

Figure 9:
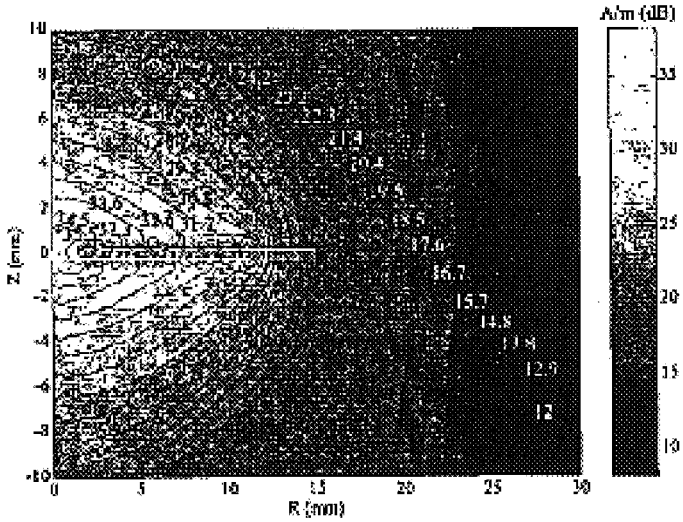
FIG. 9 is shows the simulated field intensity or a PCB transformer without shielding and in no load condition.
Figure 10:
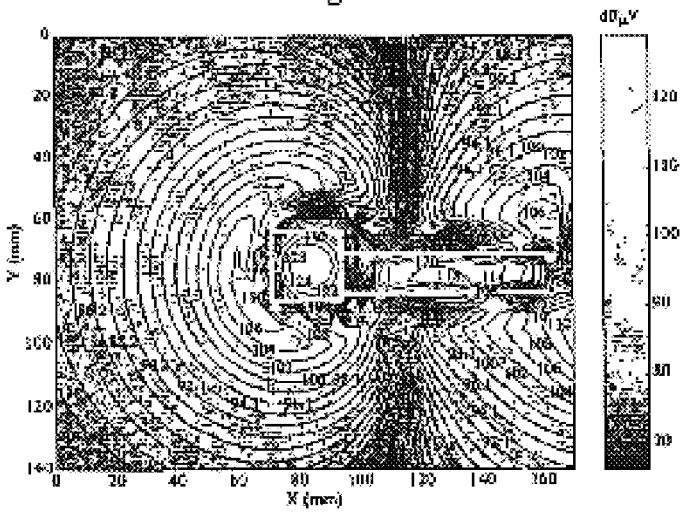
FIG. 10 shows measured magnetic field intensity of a PCB transformer without shielding and in no load condition.

The magnetic field intensity of the PCB transformer without any form of shielding and loading has been simulated and its R-Z plane is shown in FIG. 9. From the simulated result, the magnetic field intensity, at R=0 mm and Z=5 mm, is about 30 dBA/m. The measured magnetic intensity, in z-direction, is shown in FIG. 10. The white square and the white parallel lines in FIG. 10 indicate the positions of transformer and the current carrying leads of the transformer primary terminals, respectively. The output of the magnetic field transducer, at 5 mm beneath the centre of the transformer, is about 130 dB$\mu$V.

B. PCB Transformer Shielded With Ferrite Plates

Figure 11:
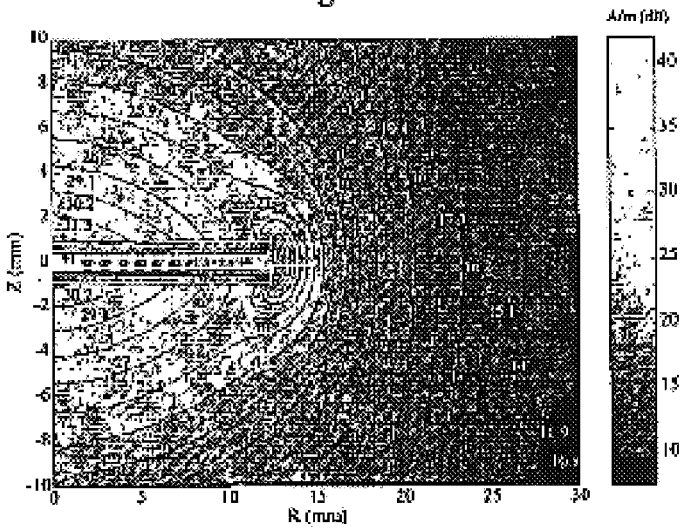
FIG. 11 shows simulated magnetic field intensity of a PCB transformer with ferrite shielding in accordance with the prior art and in no load condition.
Figure 12:
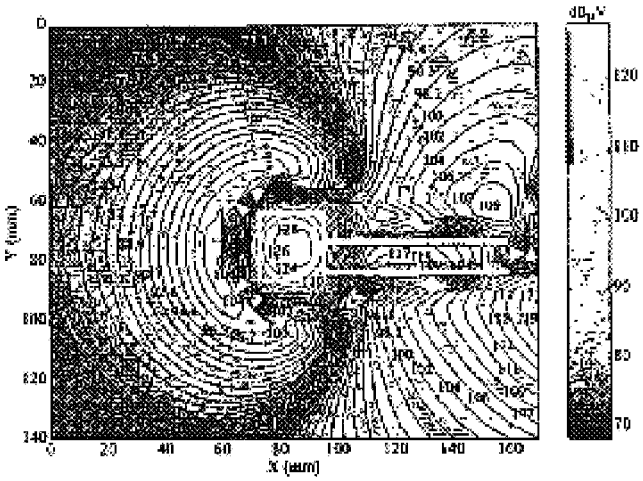
FIG. 12 shows measured magnetic field intensity of a PCB transformer with ferrite shielding and in no load condition.

The simulated magnetic field intensity of a PCB transformer shielded with ferrite plates alone, under no load condition, is shown in FIG. 11. The simulated result shows that the magnetic field intensity, at R=0 mm and Z=5 mm, is about 28 dBA/m. The measured magnetic intensity, in z-direction, is shown in FIG. 12. The output of the magnetic field transducer, at 5 mm beneath the centre of the transformer, is about 128 dB$\mu$V. Therefore, with the use of 4F1 ferrite plates, the shielding effectiveness (SE), from the simulated result, is $$SE=2\times(30-28)=4\ dB$$

The shielding effectiveness obtained from measurements is $$SE=2\times(130-128)=4\ dB$$

Both simulation and experimental results shows that the use of the 4F1 ferrite plates can reduce the magnetic field emitted from the transformer by 4 dB (about 2.5 times).

C. PCB Transformer Shielded With Ferrite Plates and Conductive Sheets

Figure 13:
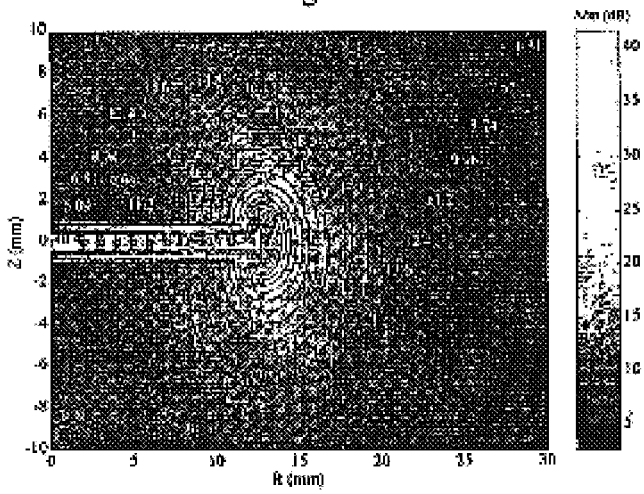
FIG. 13 shows simulated magnetic field intensity of a PCB transformer in accordance with an embodiment of the invention and in no load condition.
Figure 14:
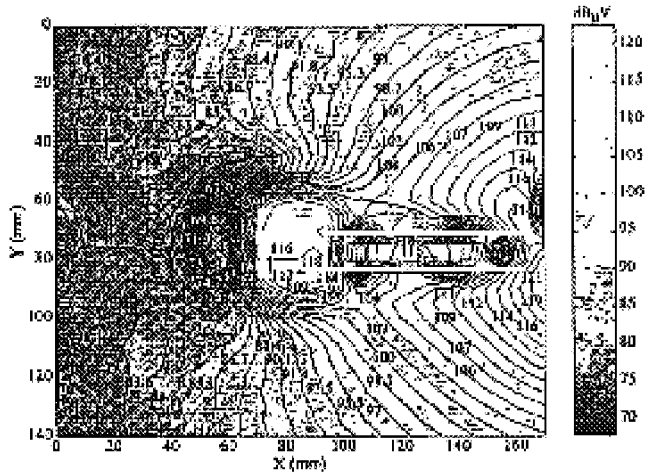
FIG. 14 shows measured magnetic field intensity of a PCB transformer in accordance with an embodiment of the present invention and in no load condition.

FIG. 13 Shows the simulated magnetic field intensity of a PCB transformer in accordance with an embodiment of the invention shielded with ferrite plates and conductive sheets under no load condition. From the simulated result, the magnetic field intensity, at R=0 mm and Z=5 mm, is about 13 dBA/m. FIG. 14 shows the measured magnetic intensity in z-direction. The output of the magnetic field transducer, at 5 mm beneath the center of the transformer, is about 116 dBμV. With the use of 4F1 ferrite plates and conductive sheets, the shielding effectiveness (SE), from the simulated result, is $$SE=2\times(30-13)=34\ dB$$

The shielding effectiveness obtained from measurements is $$SE=2\times(130-116)=28\ dB$$

As a result, the use of ferrite plates covered with conductive sheets is an effective way to shield magnetic field generated from PCB transformer. The reduction of magnetic field is 34 dB (2512 times) from simulation result and 28 dB (631 times) from measurement. The SE obtained from the measurement is less than that obtained from the simulated result. The difference mainly comes from the magnetic field emitted from the current carrying leads of the transformer. From FIG. 14, the magnetic field intensity generated from the leads is about 118 dB, which is comparable with the magnetic field generated from the transformer. Therefore, the magnetic field transducer beneath the centre of the transformer also picks up the magnetic field generated from the lead wires.

D. PCB Transformer in Loaded Condition

Figure 15:
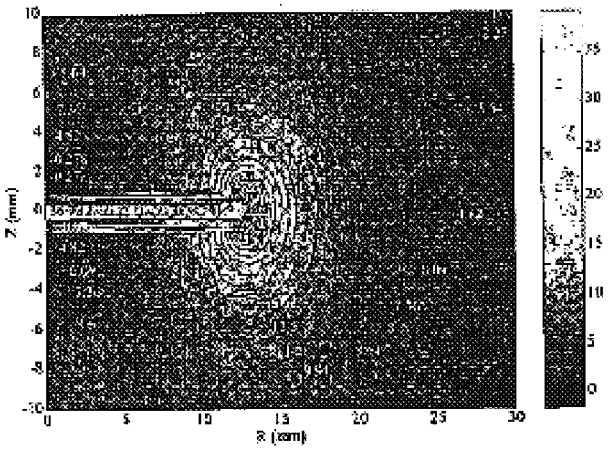
FIG. 15 shows simulated magnetic field intensity of a PCB transformer in accordance with an embodiment of the present invention and in 20Ω load condition.
Figure 16:
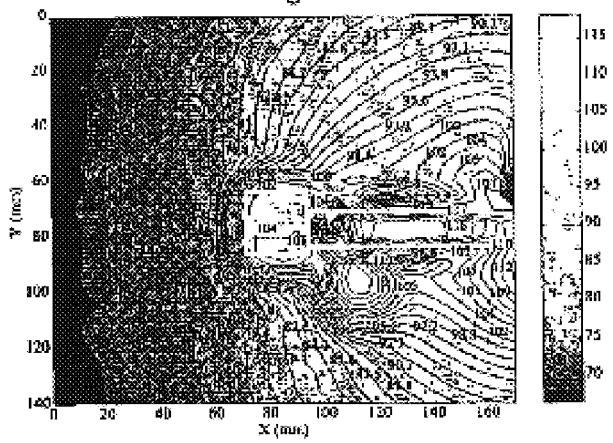
FIG. 16 shows measured magnetic field intensity of a PCB transformer in accordance with an embodiment of the present invention and in 20Ω load condition, FIG. 17 plots the energy efficiency of various PCB transformers in 100Ω load condition, and FIG. 18 plots the energy efficiency of various PCB transformers in 100Ω/100 pF load condition.

When a load resistor is connected across the secondary of the PCB transformer, the opposite magnetic held generated from secondary current cancels out part of the magnetic field setup from the primary. As a result, the resultant magnetic field emitted from the PCB transformer in loaded condition is less than that in no load condition. FIG. 15 shows the simulated magnetic field intensity of the PCB transformer shielded with ferrite plates and conductive sheets in 20Ω load condition. From the simulated result, the magnetic field intensity, at R=0 mm and Z=5 mm, is about 4.8 dBA/m, which is much less than that in no load condition (13 dBA/m). FIG. 16 shows the measured magnetic intensity in z-direction. The output of the magnetic field transducer, at 5 mm beneath the centre of the transformer, is about 104 dBμV and that in no load condition is 116 dBμV.

Figure 17:
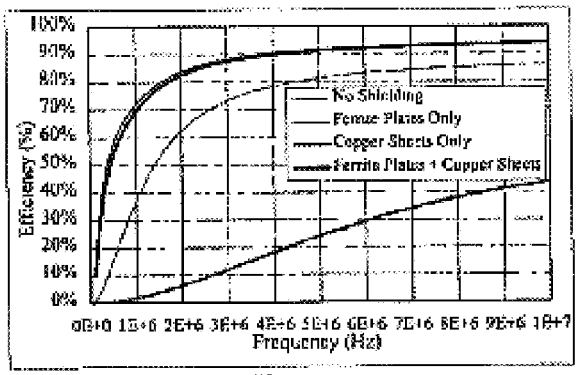

Energy efficiency of PCB transformers shielded with (i) ferrite plates only, (ii) conductive sheets only and (iii) ferrite plates covered with conductive sheets may be measured and compared with that of a PCB transformer with no shielding. FIG. 17 shows the measured energy efficiency of the four PCB transformers with 100Ω resistive load. In the PCB transformer shielded with only conductive sheets, a layer of insulating sheet of 0.684 mm thickness is used to isolate the transformer winding and the conductive sheets. From FIG. 17, energy efficiency of the transformers increases with increasing frequency. The transformer shielded with copper sheets only has the lowest energy efficiency among the four transformers. The energy loss in the conductive-shielded transformer mainly comes from the eddy current, which is induced from the normal component of the H-field generated from the transformer windings, circulating in the conductive sheets.

Figure 18:
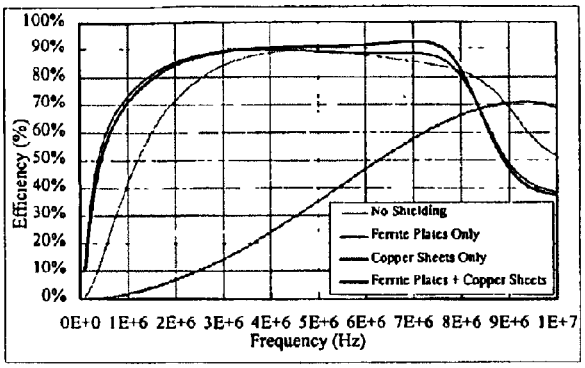

The energy efficiency of the transformer with no shielding is lower than that of the transformers shielded with ferrite plates. Without ferrite shielding, the input impedance of coreless PCB transformer is relatively low. The energy loss of the coreless transformer is mainly due to its relatively high $i^2R$ loss (because of its relatively high input current compared with the PCB transformer covered with ferrite plates). The inductive parameters of the transformers with and without ferrite shields are shown in Table II. However this shortcoming of the coreless PCB transformer can be overcome by connecting a resonant capacitor across the secondary of the transformer. The energy efficiency of the 4 PCB transformers with 100Ω//1000 pF capacitive load is shown in FIG. 18. The energy efficiency of the coreless PCB transformer is comparable to that of the ferrite-shielded transformers at the maximum efficiency frequency (MEF) of the coreless PCB transformer.

The ferrite-shielded PCB transformers have the highest energy efficiency among the four transformers, especially in low frequency range. The high efficiency characteristic of the ferrite-shielded transformers is attributed to their high input impedance. In the PCB transformer shielded with ferrite plates and conductive sheets, even though a layer of conductive sheet is provided on the surface of each ferrite plate, the eddy current loss in the conductive sheets is negligible as discussed above. The H-field generated from the transformer windings is confined in the ferrite plates. The use of thin conductive sheets is to direct the magnetic field in parallel to the ferrite plates so that the normal component of the magnetic field emitting into the conductive sheet can be suppressed significantly. The energy efficiency measurements of the ferrite-shielded transformers with and without conductive sheets confirm that the addition of conductive sheets on the ferrite plates will not cause significant eddy current loss in the conductive sheets and diminish the transformer efficiency. From FIGS. 17 and 18, the energy efficiency of both ferrite-shielded transformers, with and without conductive sheets, can be higher than 90% at a few megahertz operating frequency.

It will thus be seen that the present invention provides a simple and effective technique of magnetic field shielding for PCB transformers. Performance comparison, including shielding effectiveness and energy efficiency, of the PCB transformers shielded in accordance with embodiments of the invention, conductive sheets and ferrite plates has been accomplished. Both simulation and measurement results show that the use of ferrite plates covered with conductive sheets has the greatest shielding effectiveness (SE) of 34 dB (2512 times) and 28 dB (631 times) respectively, whereas the SE of using only ferrite plates is about 4 dB (2.5 times). Addition of the conductive sheets on the surfaces the ferrite plates does not significantly diminish the transformer energy efficiency. Experimental results show that the energy efficiency of both ferrite-shielded transformers can be higher than 90% at megahertz operating frequency. But the planar PCB transformer shielded with both thin ferrite plates and thin copper sheets has a much better electromagnetic compatibility (EMC) feature.

The conductive sheets may preferably be copper sheets, but other conductive materials may be used such as aluminum.

It should also be understood that while the printed circuit board may be a single board with the two windings formed on opposite sides, it is also possible that the two windings may be formed on separate boards that are laminated together to form a composite structure. It is also possible that the two windings may be formed on separate printed circuit boards that may be incorporated in different devices. Another possibility is that the ferrite plus conductive material shielding could also be applied to a single winding forming a PCB inductor.

TABLE II

Inductive Parameters of the PCB Transformers

| Transformers | Self-inductance of Primary Winding | Self-inductance of Secondary Winding | Mutual-inductance between Primary and Secondary Windings | Leakage-inductance of Primary Winding |
|---|---|---|---|---|
| No Shielding | 1.22 μH | 1.22 μH | 1.04 μH | 0.18 μH |
| Shielded with Ferrite Plates Only | 3.92 μH | 3.92 μH | 3.74 μH | 0.18 μH |
| Shielded with Ferrite Plates and Copper Sheets | 3.80 μH | 3.80 μH | 3.62 μH | 0.18 μH |

What is claimed is:

1. A planar printed circuit board transformer comprising at least one conductive sheet located over a ferrite plate, said plate being located over a winding, for electromagnetic shielding.

2. A planar printed Circuit board transformer comprising, (a) a printed circuit board, (b) primary and secondary windings formed by coils deposited on opposed sides of said printed circuit board, (c) first and second ferrite plates located over said primary and secondary windings respectively, and (d) first and second conductive sheets located over said first and second ferrite plates respectively.

3. A transformer as claimed in claim 2 wherein a thermally conductive insulating layer is located between each said winding and its associated said ferrite plate.

4. A transformer as claimed in claim 2 wherein said printed circuit board is a laminate, comprising at least two layers.

5. A planar printed circuit board transformer comprising:

primary and secondary winding, first and second ferrite plates located over said primary and secondary windings respectively, conductive sheets located over said first and second ferrite plates respectively for electromagnetic shielding.

6. A planar printed circuit board transformer comprising.

(a) a first printed circuit board, (b) a primary winding formed by a coil deposited on said first printed circuit board, (c) a second printed circuit board, (d) a secondary winding formed by a coil deposited on said second printed circuit board.

(e) first and second ferrite plates located over said primary and secondary windings respectively, and (f) first and second conductive sheets located over said first and second ferrite plates respectively.

7. A planar printed circuit board inductor comprising at least one conductive sheet located over a ferrite plate, said plate being located over a winding, for electromagnetic shielding.

* * * * *